United States Patent [19]

Wiley

[11] 4,053,959

[45] Oct. 18, 1977

[54] BRUSH FOR TEETH AND GUMS

[76] Inventor: Corless W. Wiley, 1505 Junior Drive, Dallas, Tex. 75208

[21] Appl. No.: 654,023

[22] Filed: Jan. 30, 1976

[51] Int. Cl.[2] ..... A46B 9/04

[52] U.S. Cl. ..... 15/106; 15/110; 15/167 R

[58] Field of Search ..... 15/167 R, 167 A, 110, 15/206, 106, 143 R

[56] References Cited

U.S. PATENT DOCUMENTS

| | | | |
|---|---|---|---|
| 1,792,188 | 2/1931 | Robey | 15/110 X |
| 1,813,076 | 7/1931 | Newell | 15/167 R |
| 1,909,432 | 5/1933 | Swanson | 15/167 R |
| 2,627,621 | 2/1953 | Bardugon | 15/206 |
| 3,559,226 | 2/1971 | Burns | 15/206 X |

FOREIGN PATENT DOCUMENTS

| | | | |
|---|---|---|---|
| 94,359 | 6/1969 | France | 15/110 |
| 16,815 | 4/1898 | Switzerland | 15/110 |
| 324,279 | 1/1930 | United Kingdom | 15/206 |

*Primary Examiner*—Peter Feldman

*Attorney, Agent, or Firm*—Peter J. Murphy

[57] ABSTRACT

An elongated handle, of rectangular cross-section, has a round, flatted brush head mounted at either one end or both ends. The brush head, according to the invention is fabricated from an originally linear, twisted wire frame having a central core portion which secures diametral bristles which effectively project radially from the core portion, and free end portions. The core portion is formed into a circular core, with the free end portions extending transversely and being secured in an axial recess in the handle. The formed brush head, then, approximates a spherical head having opposite flatted sides. The handle end to which a head is secured is preferably bent at an obtuse angle, with the plane of one head core being transverse to the handle plane defined by the main handle portion and bent handle portion. When a second head of similar construction is mounted at the opposite end of the handle, the plane of the second head core is coincident with the above mentioned handle plane. Alternatively one head is a conventional toothbrush head.

9 Claims, 6 Drawing Figures

BRUSH FOR TEETH AND GUMS

BACKGROUND AND SUMMARY OF THE INVENTION

This invention relates to a brush particularly designed for the cleaning of teeth within the mouth and for the cleansing and stimulation of gums and gum tissue.

It is well known that mouth disease, which includes both tooth decay and diseases of the gums, is very widespread and common in persons of all ages. Surveys covering large groups of people have shown that gum disease accounts for even more tooth loss than does tooth decay. Surveys have shown, also, that gum disorders are quite common even in school children, and that gum disorders are extremely common in persons of the 20 to 30 age group.

It is recognized that a careful program of daily brushing of teeth will go far toward preventing the formation of plaque resulting in tooth decay, providing that the program includes the reaching and cleansing of surfaces of the teeth which are sometimes hard to reach. It is also recognized that many of the gum disorders, which result in over one-half of tooth loss, are best treated by little more than a careful program of mouth hygiene which includes proper daily tooth brushing coupled with massage of the tissues around the teeth. Again the effectiveness of such a program is dependent upon the program having the capacity to remove soft debris from pockets and sulcus between the tooth surface and the adjacent gum tissue. The term "pocket" is generally understood to mean a recess between the tooth surface and inflamed gum tissue which is either already diseased, or is inflamed and highly susceptible to disease; while the term "sulcus" means a recess which exists between the tooth surfaces and healthy gum tissue. Soft debris must be removed from such sulcus in order to prevent them from becoming pockets. It is recognized that 95% of harmful mouth bacteria tend to mass in the area of the gum line.

In the commonly used form of toothbursh, the bristles extend parallel to each other from a flat head, and the tips of the bristles terminate generally in a common plane. Typical bristle diameters are from 0.007 to 0.012 inches. While these types of toothbrushes may be effective for removing plaque or other debris from readily exposed tooth surfaces and gum surfaces, it is only with great difficulty and care that the bristles of such a toothbrush can be made to penetrate, for example, the embrasures between adjacent teeth and effectively clean the proximal or facing surfaces of such teeth. Efforts to achieve this with a brush having bristles which are too stiff, may result in injury to the gum tissue, particularly where such tissue is already diseased, or inflamed and tender.

With such conventional toothbrushes it is substantially impossible to cleanse the pockets and sulcus of soft particles, particularly where such pockets or sulcus are at the lingual or proximal faces of the teeth.

A principal object of this invention is to provide a brush having an improved head form for the effective cleaning and massaging of tooth and gum surfaces, including tooth embrasures and crevices and gum sulcus and pockets.

Another object of this invention is to provide an improved brush for teeth and gum surfaces wherein the bristles of the brush head project generally radially from a support core providing for independent functioning of adjacent bristles of the brush head.

Still another object of this invention is to provide an improved brush for cleaning of tooth and gum surfaces wherein the bristles of the brush head project generally radially, and the bristles are soft and flexible to minimize abrasive injury to the gum tissues.

A still further object of this invention is to provide a brush for teeth and gum surfaces, having a brush head and handle configuration to enable ready access to all surfaces, including sulcus and pockets, of the teeth and gums within the mouth.

These objects are accomplished in a brush for teeth and gums, which comprises an elongated handle and a generally flat, round brush head fixed to one end of the handle. The head includes bristles which project outwardly in all directions from a round generally planar core, with the bristles defining opposite generally flat brush faces, parallel with the core plane, and a rounded peripheral surface. The handle includes a major linear portion; and the head is fixed to the handle with its core plane being inclined at an obtuse angle relative to the axis of this handle major linear portion. In more particular form the handle includes a minor linear portion at one end, formed with its axis at an obtuse angle relative to the major linear portion; and with the brush head being fixed to the distal end of the minor linear portion. Still more particularly, a second similar brush head may be fixed to the other end of the handle, with the plane of the second head core being generally perpendicular to the core of the first head.

The novel features and the advantages of the invention, as well as additional objects thereof, will be understood more fully from the following description when read in connection with the accompanying drawings.

DRAWINGS

DESCRIPTION OF THE PREFERRED EMBODIMENTS

Figure 1:
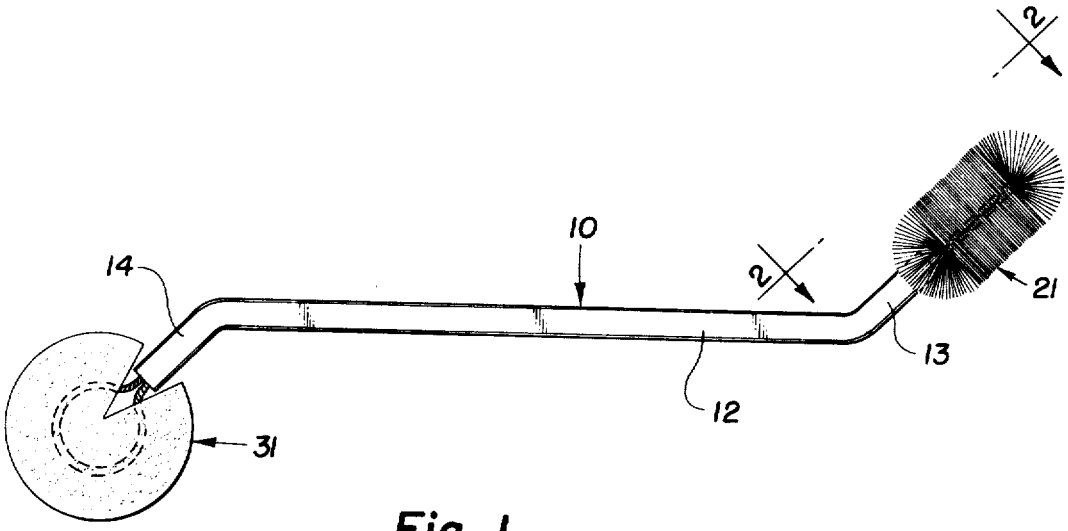
FIG. 1 is a side view of a toothbrush according to the invention, including individual heads at opposite ends of the brush handle.

This invention is concerned generally with a toothbrush having a brush head which is round and flatted, that is having two opposite generally flat faces and a rounded and circular periphery, with the entire surface of this head being formed by bristles which extend outwardly from a central core which is round and generally planar or flat. In one conceptual form, the core might be in the form of a circular disk having bristles extending transversely from the faces of the disk and radially from the periphery of the disk (i.e. from the circle defined by the periphery of the disk). In a practical construction of such a brush head, the core may be formed from a pair of twisted wires, initially linear, and supporting radially projecting bristles; with the twisted wire then being formed into a circle to define a doughnut-like head, closed or nearly closed at the center, which head effectively defines the opposing flat faces and the rounded periphery described above.

Brush heads of this type have been referred to as "twisted wire type"; and forms of such brush heads are illustrated and described in Swanson U.S. Pat. No. 1,909.437, issued May 16, 1933, and Lockwood U.S. Pat. No. 1,939,996, issued Dec. 19, 1933. A preferred form of twisted wire type head will be described subsequently.

In its broader form this invention is concerned with the combination of one round flatted brush head and an elongated handle for supporting such head. In the form of brush illustrated in FIGS. 1 and 2 of the drawing, two such heads are mounted on a common handle; and in FIG. 3 one such head is mounted on a common handle with a conventional form of toothbrush head.

Figure 2:
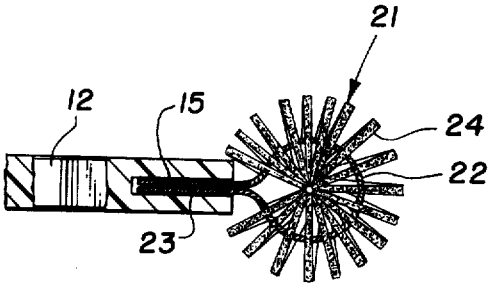
FIG. 2 is a fragmentary view, partially in section, of a portion of the brush of FIG. 1 as viewed from the plane 2—2 thereof.

FIGS. 1 and 2 of the drawing illustrate one form of toothbrush 10 according to the invention including an elongated handle 11, a first brush head 21 and a second brush head 31.

The handle may be fabricated from any suitable material, such as plastic material, from which the handles of conventional toothbrushes are fabricated; and is an elongated member, preferably having a rectangular cross-section to enable grasping by the user in a manner to easily position the brush head or heads in the desired manner. By way of example, the handle cross-section may be $\frac{3}{8} \times 3/16$ inch. In the form illustrated in FIG. 1 the handle includes a central linear portion 12, which is referred to as a major linear portion; and includes bent linear portions 13 and 14 which are referred to as minor linear portions. These minor linear portions are bent at an obtuse angle relative to the major linear portion, which angle may be about 45° for example. The length of the major linear portion 12 may be about 5 inches for example, with the lengths of the minor linear portions 13 and 14 each being about 1 inch for example.

In the illustrated form, the minor end portions 13 and 14 are bent in opposite directions relative to each other from the major linear portion in a manner that all three linear portions 12, 13 and 14 define generally a common plane.

Reference to "the plane of the handle" refers to such plane defined by the major linear portion and at least one minor linear portion. As best seen in FIG. 2, axial recesses 15 are provided in each end of the handle 11 for the purpose of mounting the brush heads as will be described.

The construction of the brush head will now be described with reference to the brush head 21; and all of the round, flatted brush heads referred to herein are of the same or similar construction. As mentioned, the brush head is of the so-called twisted wire type; and is formed with a frame formed with two strands of wire twisted together and carrying bristles held in place between the convolutions of the wire. In the fabrication of the brush head, the frame is initially linear having an intermediate core portion 22, which carries the bristles 24, and two free end portions 23. By way of example of the size of the brush head, the linear core portion 22 may have a length of 2 inches for example, with each free end portion 23 having a length of up to 1 inch. The bristles 24 are supported generally diametrically; and a continuous swirl of bristles is supported by the core portion of the frame. After fabrication of the brush head in linear form, the bristles may be trimmed to a radial length of about 5/16 inch for example. To form the rounded brush head, the core 22 is formed into a circular ring, thereby forming a doughnut-shaped bristle head with a core diameter of about $\frac{5}{8}$ inches and with the head therefore having substantially no opening at the center. The brush head then has an overall diameter of about $1\frac{1}{4}$ inches and a width of about $\frac{5}{8}$ inch.

The free ends 23 are then bent radially outwardly in the plane of the core 22, so that they extend side-by-side as best seen in FIG. 2. The head is then secured to the handle 10 by directing the free ends 23 into a handle recess 15 which is filled with a suitable cement, so that the head is firmly fixed to the handle. In the brush illustrated in FIGS. 1 and 2, the brush head 21 is illustrated in one orientation relative to the handle wherein the plane of the head core 22 is transverse to the handle plane defined by the major linear portion 12 and minor linear portion 13; and the longitudinal axis of the minor linear portion 13 lies in the plane of the head core 22 (also referred to as the plane of the head 21).

The above described doughnut configuration approximates a brush head which is flat and rounded; that is having two oppositely facing generally flat faces with the periphery of the head being circular and rounded with radially projecting bristles. While the bristles which form the face of the head are not all perpendicular to the plane of the head core, a sufficient number of bristles are essentially perpendicular to the core plane so that the opposite faces of the brush head function as flat brushing surfaces.

To further describe the characteristics of a brush head by way of example, a brush head having a circumference of 2 inches may have about 20 swirls (360° swirls) of bristles with each swirl including about 200 diametral bristles of 0.003 inch thickness, and each diametral bristle functions as two radial bristles. Accordingly such a brush head would have 8000 bristles, with perhaps about 25% of the bristles being ineffective since they are directed toward the center of the doughnut-shaped head.

The applicant believes that a brush head carrying bristles of this thickness are effective to (1) massage the gums, (2) to remove plaque from the surfaces of the teeth, and (3) particularly due to the fact that the bristles extend radially from the core periphery, are effective to enter embrasures between the teeth, and to enter linqual and facial and interproximal sulcus and pockets between the teeth and gums to remove deposits therefrom without injurying tender gum tissue.

Referring again to the toothbrush of FIG. 1, this brush assembly includes a second head 31 carried on the opposite end of the handle 11, with the brush head 31 being identical in overall construction with the head 21. The brush head 31 however is mounted with its head plane (core plane) disposed in the handle plane, and offset from the handle major linear portion; and this relationship may be preferable for the brushing of the occlusal surfaces of the molars.

It will be understood of course that where the heads 21 and 31 are fabricated with wire frames as above described, even after mounting on a handle in a particular orientation, the heads may be bent to a different relative orientation.

Figure 3:
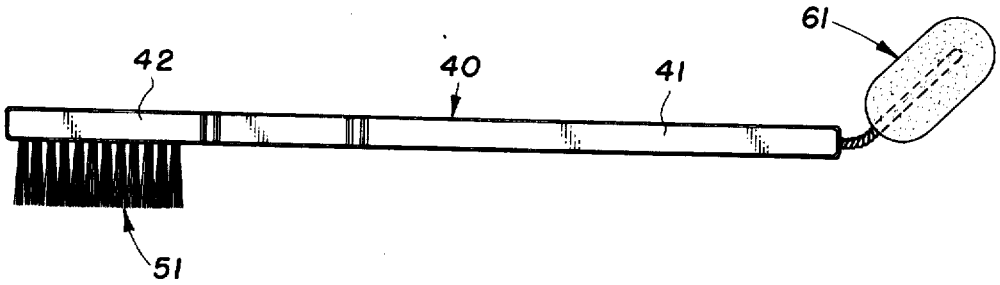
FIG. 3 is a side view of an alternative form of toothbrush, including a conventional brush head at one end of the handle and a head according to the invention at the other end.

FIG. 3 of the drawing illustrates another toothbrush combination 40 including an elongated linear handle 41 fabricated from a suitable plastic material and having a generally rectangular cross-section in the manner of a conventional toothbrush handle; and this brush handle 41 carrying a conventional brush head 51 at one end and a rounded head 61 at its other end having a structure substantially identical to the head 21 and mounted to the handle in a similar manner. It will be noted that in the fabrication of this brush the frame of the head 61 may initially coincide with the longitudinal axis of the handle 41, with the head frame then being bent so that the plane of the core is inclined at an obtuse angle relative to the handle axis. The relative handle head orientation then is generally the same as that for the handle 12-head 21 assembly of FIG. 1, but without the handle being bent to provide a minor linear portion.

The brush head 51, referred to as a conventional brush head, may be fabricated from bristles of nylon or other suitable material having a thickness of 0.007 inches for example. As is well known, the bristles of a conventional toothbrush are mounted in a flat core, integral with the handle, in clumps or rounds of bristles which are arranged in rows; with the bristles projecting perpendicular from the flat core, and with the ends of the bristles terminating in a generally flat brushing face parallel with the head core. The bristles may be about 7/16 inch in length and the rounds of bristles may be arranged in four side-by-side linear rows of 11 rounds each for a total of 44 rounds. If a head includes about 40 bristles per round, the above described head would then be made up of 44 × 40 or 1760 bristles.

The toothbrush illustrated in FIG. 3, then, is a combination of a brush according to applicant's invention, consisting of a handle and associated rounded flat head inclined relative to the handle axis, and a conventional toothbrush head. Applicant believes that a brush according to his invention, designed for the principal purpose of gum care through gentle massage, treatment of diseased gums through gentle removal of soft deposits from gum pockets, and removal of plaque from teeth surfaces, is best accomplished by means of a brush head having relatively soft bristles, and with the bristles projecting generally radially from a head core. The applicant believes that heads provided with bristles having a thickness in the range of from about 0.001 to 0.005 inches would be effective for this purpose. Applicant believes that the minimum bristle thickness available in conventional toothbrushes is about 0.007; and bristles of this thickness frequently cause injury to and bleeding of tender gum tissues. Additionally the head design of applicant is designed to get below the gum line, that is into the above mentioned gum pockets and sulcus, which is difficult, if not impossible to do with a conventional toothbrush head. The conventional toothbrush head with a flat relatively firm brushing surface may be better suited to removing hardened deposits from the surfaces of teeth which are accessible to such brush head; however, with the regular, frequent and thorough use of a softer brush, the formation of hardened deposits should be minimized.

DESCRIPTION OF USE

Figure 5:
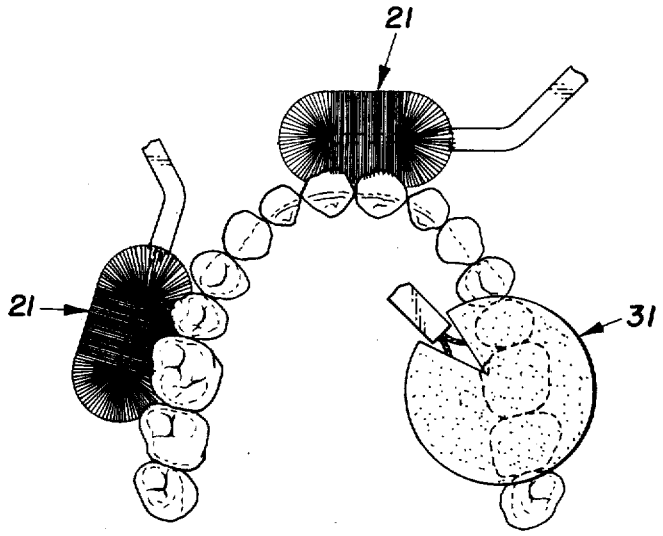
FIGS. 4 through 6 are diagrammatic views of dental arches illustrating applications of use of the toothbrush according to the invention.
Figure 6:
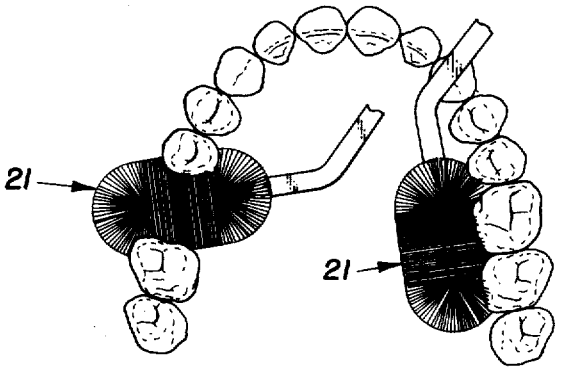
Figure 4:
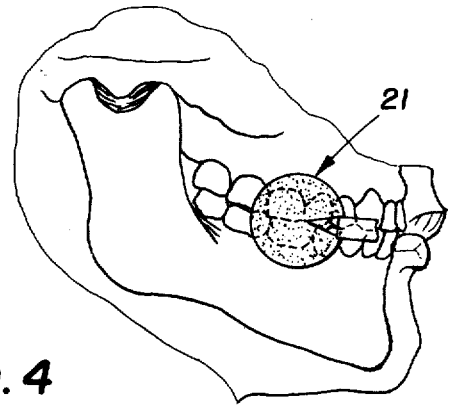

FIGS. 4 through 6 are different diagrammatic views of dental arches illustrating particular applications of the above described toothbrush with particular reference to the orientation of the brush head relative to the mouth of the user.

FIG. 4 is a side view of both the maxillary and mandibular arches and adjacent gums, particularly illustrating how the flat face of a brush head 21 may be used to clean the facial surfaces of both posterior and anterior teeth, the brushing of the posterior teeth being illustrated. FIG. 4 illustrates, by way of example, a suitable size of a brush head 21 relative to a typical mouth; and it will be seen that the diameter of the head is sufficient that when the brush head is moved laterally, that is parallel with the plane of occlusion of the two arches, that the surfaces of the head will engage not only the surfaces of the teeth but also the gum tissue. Of course the brush head may also be moved vertically to assure penetration of tooth crevices, embrasures etc. For better penetration of bristles into the embrasures, the brush head may be moved upward or downward and rocked to employ the peripheral bristles. The employment of the peripheral radial bristles will assure better penetration of the bristles into the embrasures to clean the proximal (or facing) surfaces of adjacent teeth and also to massage the gum tissue within the embrasures. While it is recognized that a conventional toothbrush head 51 is suitable for cleaning the facial surfaces of the teeth, it is most difficult for the bristles of such a head to enter the embrasures.

A brush head having the orientation and configuration of the head 31 of FIG. 1, may also be used to perform the uses discussed above.

FIG. 5 is a diagrammatic plan view of the mandibular arch, for example, further illustrating the use of the brush head 21 and associated handle configuration illustrated in FIG. 1 for the brushing of the facial surfaces of both posterior and anterior teeth. The position of the left hand brush in FIG. 5 is generally the same as that of the brush head illustrated in FIG. 4. From this figure and from FIG. 4, it will be seen that by positioning the brush head so that one rounded edge of the head moves along the gum line for example, the radial bristles of the head will readily move into sulcus and pockets associated with the facial surfaces of the teeth. By other manipulation more particularly described with respect to FIG. 4, these radial bristles move into the embrasures; and vertical movement of the brush head will allow penetration of the bristles into sulcus or pockets between the gum tissue and the proximal surfaces of the teeth within the embrasures.

FIG. 5 also illustrates the use of a flat side of the brush head 31 for the brushing of the occlusal surfaces of the posterior teeth. While it appears that the head configuration 31 and its orientation with the brush handle would be preferable for the cleaning of these occlusal surfaces, with associated ridges and crevices, these surfaces may also be brushed with the head configuration 21.

FIG. 6 is also a diagrammatic plan view of a dental arch illustrating uses of the brush head 21 particularly in cleaning lingual, proximal and distal faces of the teeth. In the right hand illustration of the head in FIG. 6, the head 21 is illustrated with one flat face brushing the lingual faces of the posterior teeth; and again with suitable manipulation of the head the bristles thereof can be made to pass into the embrasures for cleaning the associated proximal surfaces and pockets. It will be seen that by movement of the brush around toward the front of the dental arch, the lingual and proximal surfaces of the anterior teeth may be brushed in a similar manner. It will be apparent that the bristles of the upper and lower edges of the brush head 21, as illustrated in the right hand view will be massaging the gums and will be in position to move into the sulcus and pockets at the lingual faces to move food debris and plaque therefrom in a similar manner.

The left hand illustration of the head 21 in FIG. 6 particularly illustrates the use of this head 21 to clean the proximal surfaces of confronting molars, where a molar is missing through extraction, and again the bristles of the head 21 are positioned for cleaning of any sulcus or pockets associated with the proximal faces. In the same manner the distal surface of the last molar and any associated sulcus or pockets are readily accessible to this head 21.

What has been described is a novel form of toothbrush particularly adapted for overall mouth cleanliness including all surfaces of the teeth and surfaces of adjacent gum tissue, particularly adapted to reach tooth surfaces which are normally difficult of access such as the proximal tooth surfaces within embrasures, and also particularly adapted for the cleaning of food particles from sulcus and pockets between the teeth and adjacent gum tissues whether these pockets are adjacent to the facial teeth surfaces, the lingual teeth surfaces, or the proximal teeth surfaces within embrasures.

A particular feature of the brush head is that many of the bristles project generally radially from a central core, to enable the bristles to act more or less independently of each other and thereby enabling the bristles to penetrate sulcus and pockets and tooth crevices for better overall cleansing of the teeth and gum surfaces.

Another particular feature of the brush head is that the head contains many more bristles, but finer bristles, in relation to head size, for the effective cleaning of teeth and gums and for the massaging and stimulation of gums. As has been mentioned, the usual toothbrushes which are presently available have bristles which range in thickness from a minimum of 0.007 inch and commonly up to 0.012 inch and larger. Brushes, which are referred to as very soft for use with persons having periodontal problems, have bristles of a minimum thickness of 0.007 inch. Ordinarily, toothbrush bristles of this size cannot reach the tiny grooves and indentations, called pits and fissures, in the posterior teeth.

The soft tiny bristles of the brush according to the invention can penetrate these pits and fissures for better removal of plaque therefrom. When pressed against the tooth, the brush heads of the invention conform more to the shape of the tooth, and penetrate more readily into the sulcus and pockets for more thorough cleansing. As the brush head flattens it covers more surface and therefore cleans more tooth and subgingeval areas. The bristles will work between the teeth and below the gum line (like dental floss), and will work under and around fixed bridgework and orthodontic appliances, to remove and clear plaque and food debris from inderdental spaces. Also the soft tiny bristles can be used without toothpaste, as a vehicle to locate any presence of bacteria above and below the gum line, by just simply "smelling" of the brush head. Also it can carry medication for relief under the gingeval margin.

The applicant has discovered from use of a brush including heads as above described, that this brush is very effective in completely and thoroughly cleansing the mouth as has been described. For thorough cleansing, engagement of the brush bristles with all surfaces to be cleansed is necessary; and this contemplates thorough and slow working of the head relative to all surfaces to be cleaned, as opposed to rapid scrubbing motion which is encouraged by the configuration of conventional brush heads represented by the head 51 in FIG. 3.

The use of the described brush in this manner, while very effective, is also very comfortable and not abrasive with respect to tender gums and teeth.

While preferred embodiments of the invention have been illustrated and described, it will be understood by those skilled in the art that changes and modifications may be resorted to without departing from the spirit and scope of the invention.

What is claimed is:

1. A brush for use in brushing of teeth and gums comprising an elongated narrow handle and an enlarged brush head disposed at one end of said handle; said brush head dimensioned to be fully received within the mouth of the user;

said head comprising a ring-shaped, generally planar, twisted-wire core with bristles radiating outwardly in all directions from the wire of said core; said radiating bristles being of generally uniform length, and of sufficient length to enter embrasures between the teeth; said core being of a diameter that said head has substantially no opening at the center; said brush head thereby defining opposite generally flat faces, parallel with said core plane, and a rounded peripheral surface;

and said bristles having a uniform thickness, and having a thickness in the range of about 0.001 inch to 0.005 inch.

2. A brush as set forth in claim 1 said handle comprising a major linear portion; and said head being disposed with its core plane coincident with the axis of said major linear portion, and offset from said major linear portion.

3. A brush as set forth in claim 1 said handle comprising a major linear portion; and said head being disposed with its core plane inclined at an obtuse angle relative to said major linear portion.

4. A brush as set forth in claim 2 a second head disposed at the other end of said handle with its core plane inclined at an obtuse angle relative to said major linear portion.

5. A brush as set forth in claim 2 said handle including a minor linear portion at said one end thereof formed at an obtuse angle relative to said major linear portion.

6. A brush for teeth and gums comprising an elongated handle and first and second generally flat, rounded brush heads disposed at opposite ends of said handle; said heads each comprising a round generally planar core with bristles radiating outwardly in all directions from said core, to define opposite generally flat brush faces, parallel with the plane of the core, and a rounded peripheral surface;

said handle comprising a major linear portion, and first and second minor linear portions at the opposite ends thereof; the axes of each of said minor linear portions being disposed at an obtuse angle relative to the axis of said major linear portion, with said major and minor linear portion axes being disposed in a common plane;

said first brush head being disposed at one of said minor linear portions, with its core plane generally perpendicular to said handle common plane and inclined at an obtuse angle relative to said major linear portion; and said second brush head being disposed at the other of said minor linear portions, with its core plane coincident with said common handle plane.

7. A brush as set forth in claim 1 said brush head being formed from an initially linear frame of wire members twisted on each other, with radially extending bristles fixedly secured in place therebetween along a length of the frame intermediate its ends defining a core portion of said frame; said frame including free end portions;

said frame core portion being formed to a generally planar, circular ring with bristles of said brush head projecting generally radially outward from the axis of said core ring;

said brush head being secured to said handle by means of said frame free end portions.

8. A brush as set forth in claim 7 said head frame free end portions projecting transversely from said frame ring in side-by-side relation; said handle having an axial recess in one end to receive said frame end portions; and said frame end portions being secured within said recess whereby said head is rigidly fixed to said handle.

9. A brush as set forth in claim 1 said bristles having a thickness of about 0.003 inch.

* * * * *